US007138892B2

(12) United States Patent
Benard et al.

(10) Patent No.: US 7,138,892 B2
(45) Date of Patent: Nov. 21, 2006

(54) METHOD AND APPARATUS FOR SOFT-FAULT TOLERANT CIRCUIT INTERRUPTION

(75) Inventors: David J. Benard, Newbury Park, CA (US); Mark A. Clayton, Simi Valley, CA (US)

(73) Assignee: Rockwell Automation Technologies, Inc., Mayfield Heights, OH (US)

( * ) Notice: Subject to any disclaimer, the term of this patent is extended or adjusted under 35 U.S.C. 154(b) by 0 days.

(21) Appl. No.: 10/954,730

(22) Filed: Sep. 30, 2004

(65) Prior Publication Data

US 2006/0066426 A1 Mar. 30, 2006

(51) Int. Cl.
*H01H 75/00* (2006.01)
*H01H 77/00* (2006.01)

(52) U.S. Cl. ..... 335/16; 335/195

(58) Field of Classification Search ..... 335/16, 335/147, 132, 195, 165–176, 202; 218/22
See application file for complete search history.

(56) References Cited

U.S. PATENT DOCUMENTS 3,953,811 A * 4/1976 Mostosi ..... 335/16
4,650,944 A * 3/1987 Tedesco et al. ..... 200/401
5,266,760 A * 11/1993 Link et al. ..... 200/244
5,313,033 A * 5/1994 Link et al. ..... 200/401
5,834,723 A * 11/1998 Wieloch ..... 218/30

* cited by examiner

*Primary Examiner*—Elvin Enad
*Assistant Examiner*—Bernard Rojas
(74) *Attorney, Agent, or Firm*—Patrick S. Yoder; Alexander M. Gerasimow

(57) ABSTRACT

In accordance with one embodiment, the present technique provides a circuit interrupter. The exemplary circuit interrupter includes conductive spanner that completes an electrical pathway between first and second electrical conductors. To facilitate a good electrical connection between the conductive spanner and the first and second conductors, the exemplary interrupter includes a biasing mechanism that biases the conductive spanner toward the first and second conductors. However, in the event of a fault condition, for instance, the conductive spanner is displaced away from the first and second conductors by magnetic forces, and the electrical path is interrupted. To facilitate this displacement, the biasing mechanism presents an opposing force to displacement relationship with a negative slope. That is to say, the biasing force provided by the biasing mechanism decreases as the distance between the conductive spanner and the first and second electrical conductors increases. Additionally, pistons driven by arc heated gases engage the biasing mechanism to assist the magnetic forces during the interruption of soft faults.

33 Claims, 6 Drawing Sheets

FIG. 1
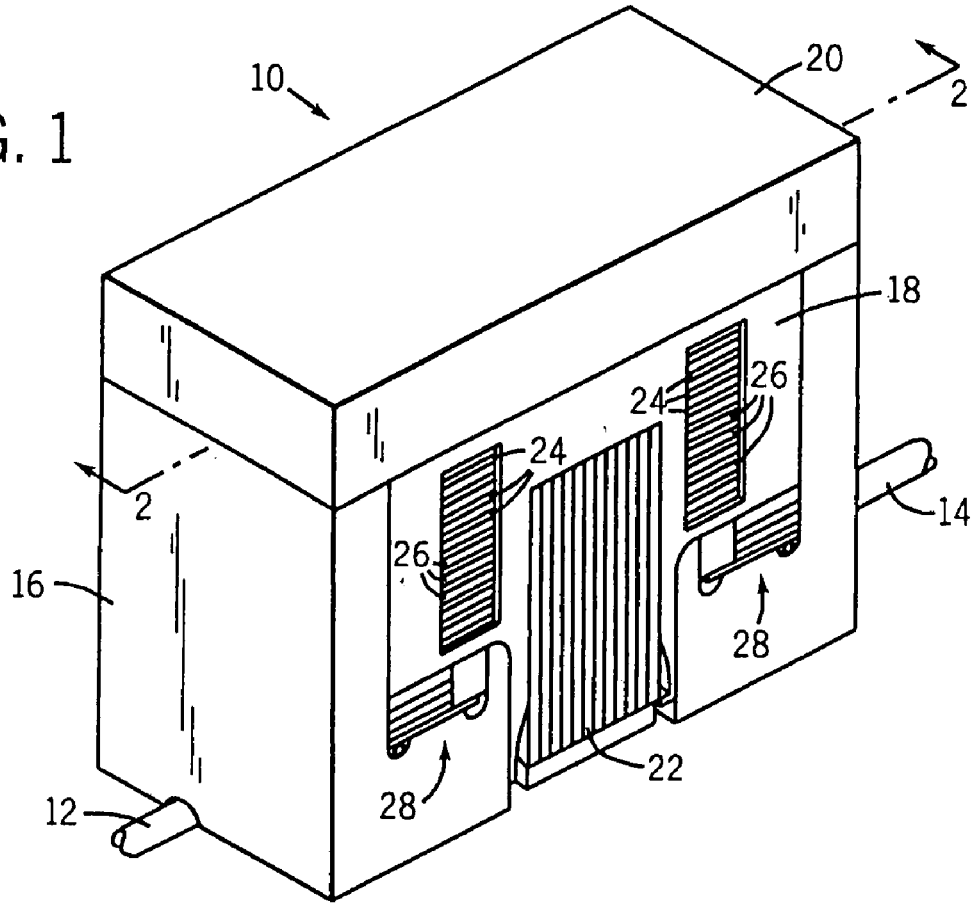
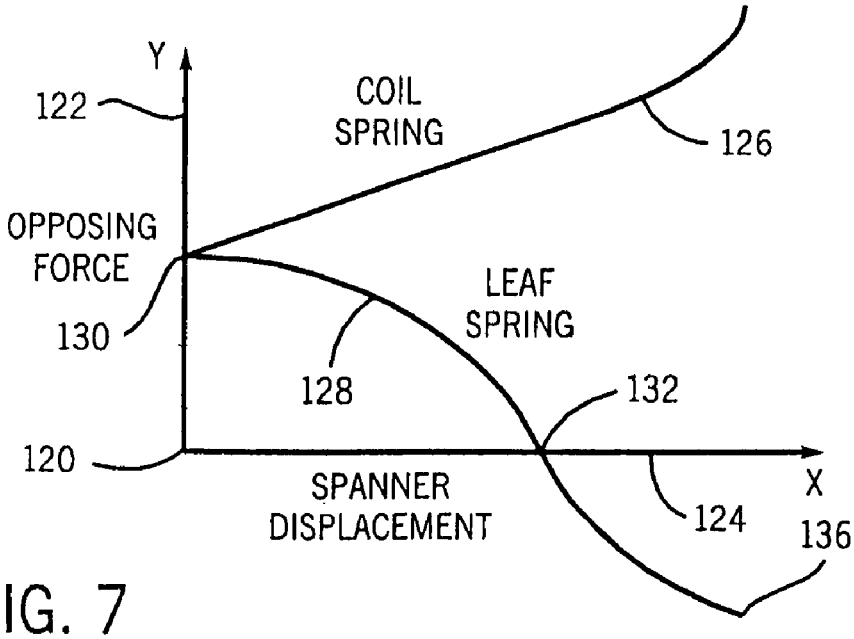
FIG. 7

METHOD AND APPARATUS FOR SOFT-FAULT TOLERANT CIRCUIT INTERRUPTION

BACKGROUND

The present technique relates generally to the field of electrical circuit interruption. More specifically, the present technique relates to methods and apparatus for interrupting electrical currents and paths between a source of electrical power and a downstream load.

In order to protect downstream devices (i.e., loads) from excessive and/or undesirable power levels, electrical pathways coupling the device to the power source are traditionally interrupted before the undesirable power reaches the device. Typically, a protection or interruption device, such as a circuit breaker or a fuse, accomplishes this interruption.

In conventional circuit breakers, a moveable member acts as an electrical bridge during normal operating conditions and is pressed against the contacts to provide a good electrical connection between the contacts and the moveable member. However, if a fault condition, such as an over current condition, is detected, the moveable member is driven out of position, breaking the engagement between the moveable member and the contacts and interrupting the current carrying path.

Currently, a variety of actuation mechanisms are employed to drive the moveable member from a conducting position to an interrupted position. For example, certain actuation mechanisms employ electromagnetic relationships to drive the moveable member into the interrupted position. As one example, "slot-motor" circuit breakers (a device of this type is described in U.S. Pat. No. 5,587,861, which issued on Dec. 24, 1996 to Wieloch et al.) employ a lightweight conductive spanner (i.e., moveable member) that is rapidly displaced under the influence of an electromagnetic field generated by a core and winding arrangement. In summary, when a sufficient current is applied to the slot-motor circuit breaker, the electromagnetic forces produced by this current drives the conductive spanner away from the contacts and, resultantly, interrupt the current carrying path. Moreover, the rapid displacement of the spanner causes a significant investment in expanding arcs that effectively extinguish the arc within an intermediary of stacked conductive splitter plates and internally with respect to the circuit breaker. Advantageously, this investment dissipates the electrical current and mitigates the likelihood of undesirable electrical current reaching the downstream load.

However, during normal operations, traditional slot-motor circuit breakers, for example, employ a biasing mechanism that drives the conductive spanner into engagement with the contacts. By way of example, slot-motor circuit breakers often include a coiled spring that drives the conductive spanner into the contacts, to facilitate a good electrical connection between the spanner and the contacts. Indeed, poor engagement between the contacts and the conductive spanner can increase the electrical resistance of the current carrying path and, in turn, generate undesirable levels of heat that can damage the circuit breaker and/or reduce its performance. Accordingly, the coiled spring is configured to provide a force on the spanner to prevent unacceptable levels of resistive heating and to retain the spanner in its starting position.

Unfortunately, the biasing (i.e., opposing) force that acts against the conductive spanner to engage the spanner with the contacts also opposes the electromagnetic force that rapidly separates the conductive spanner from the contacts during a fault condition. In the case of a coiled spring, the biasing force increases as the conductive spanner is driven further away from the contacts. ($F_{sp}$=kx; where $F_{sp}$ is the force applied by the spring; k is the spring constant and x is the distance displaced.) The magnetic force, however, scales as the square of the fault current and decreases as the spanner is displaced from its starting position. Accordingly, to interrupt the current path by moving the spanner a sufficient distance away from its starting position, a relatively large amount of current is needed to produce an electromagnetic force that is sufficient enough to overcome the biasing or opposing force on the conductive spanner. Thus, certain low amperage fault conditions, which are often referred to a "soft-faults" and which can be damaging to the downstream loads, may not produce a sufficient enough electromagnetic force to overcome the biasing force. Resultantly, if the circuit breaker fails to interrupt the current carrying path, the undesirable power passes to the downstream loads, increasing the likelihood of damage to the downstream loads, for instance.

Moreover, certain electrical codes mandate that a circuit breaker be configured to trip (i.e., respond to a fault condition) over a wide range of potential fault currents, such as from the rated current (100 Amps, for example) up to potentially available fault currents as high as 10,000 Amps or more. Therefore, traditional circuit breakers are configured to include at least two interruption mechanisms: a fast acting slot motor for the high fault currents and a more slowly acting bimetal strip that activates an interruption under lower fault current or overload conditions, for example. To provide effective continuity of coverage between these two mechanisms, the slot motor component should interrupt successfully down to 15 times rated current. Accordingly, in a 100 Amp application, the slot motor component must be able to respond to a fault condition of 1.5 kA.

Under these soft fault conditions, the driving magnetic force is reduced by a factor of approximately 45 as compared to a 10,000 Amp hard fault. Thus, in traditional slot-motor based designs, the biasing force exceeds the electromagnetic force produced by a 1.5 kA current once the spanner begins to move significantly away from its starting position, limiting the range of spanner displacement. In other words, the spanner cannot transition to the interrupted configuration before the electromagnetic force falls below the biasing force, even if the electromagnetic force was initially sufficient to overcome the biasing force. This conflict presents a significant barrier to the effective design of circuit breakers that use a magnetically driven hard fault interruption mechanism, such as a slot motor.

There is a need, therefore, for improved methods and techniques for current pathway interruption.

BRIEF DESCRIPTION

In accordance with an exemplary embodiment of the present technique, a circuit interrupter is provided. The exemplary circuit interrupter includes first and second electrical conductors configured to, in cooperation with other components, route power from a power source to a downstream load. To militate against the likelihood of undesirable power reaching the downstream load, the exemplary interrupter is configured to interrupt the current carrying path if an undesirable power is detected.

To interrupt the current carrying path, the exemplary interrupter includes a third conductor that electrically couples the first and second conductors during normal operation but displaces away from the first and second conductors during a fault condition. Specifically, the exemplary interrupter employs an electromagnetic force to displace the third conductor, and this displacement breaks or interrupts the current carrying path.

However, to facilitate good electrical connection between the first, second and third electrical conductors during normal operation, the exemplary interrupter includes a biasing mechanism that provides a biasing force to bias the third conductor toward and into engagement with the first and second conductors. However, the exemplary biasing mechanism presents an opposing force to displacement profile that decreases in amplitude as the spanner displacement increases and eventually changes sign so as to act in concert with the electromagnetic force once the displacement exceeds a critical value. Additionally, the exemplary interrupter includes piston elements that actuate in response to pressure within the interrupter and that cooperate with the electromagnetic force to drive the interrupter into the interrupted configuration.

DRAWINGS

These and other features, aspects and advantages of the present invention will become better understood when the following detailed description is read with reference to the accompanying drawings in which like characters represent like parts throughout the drawings, wherein:

FIG. 1 is a perspective view of a circuit interrupter, in accordance with an exemplary embodiment of the present technique;

FIG. 7 is a graphical representation of an opposing force applied by the biasing member of the circuit interrupter of FIG. 1 during transition from the current carrying configuration to the interrupted configuration.

DETAILED DESCRIPTION

Figure 2:
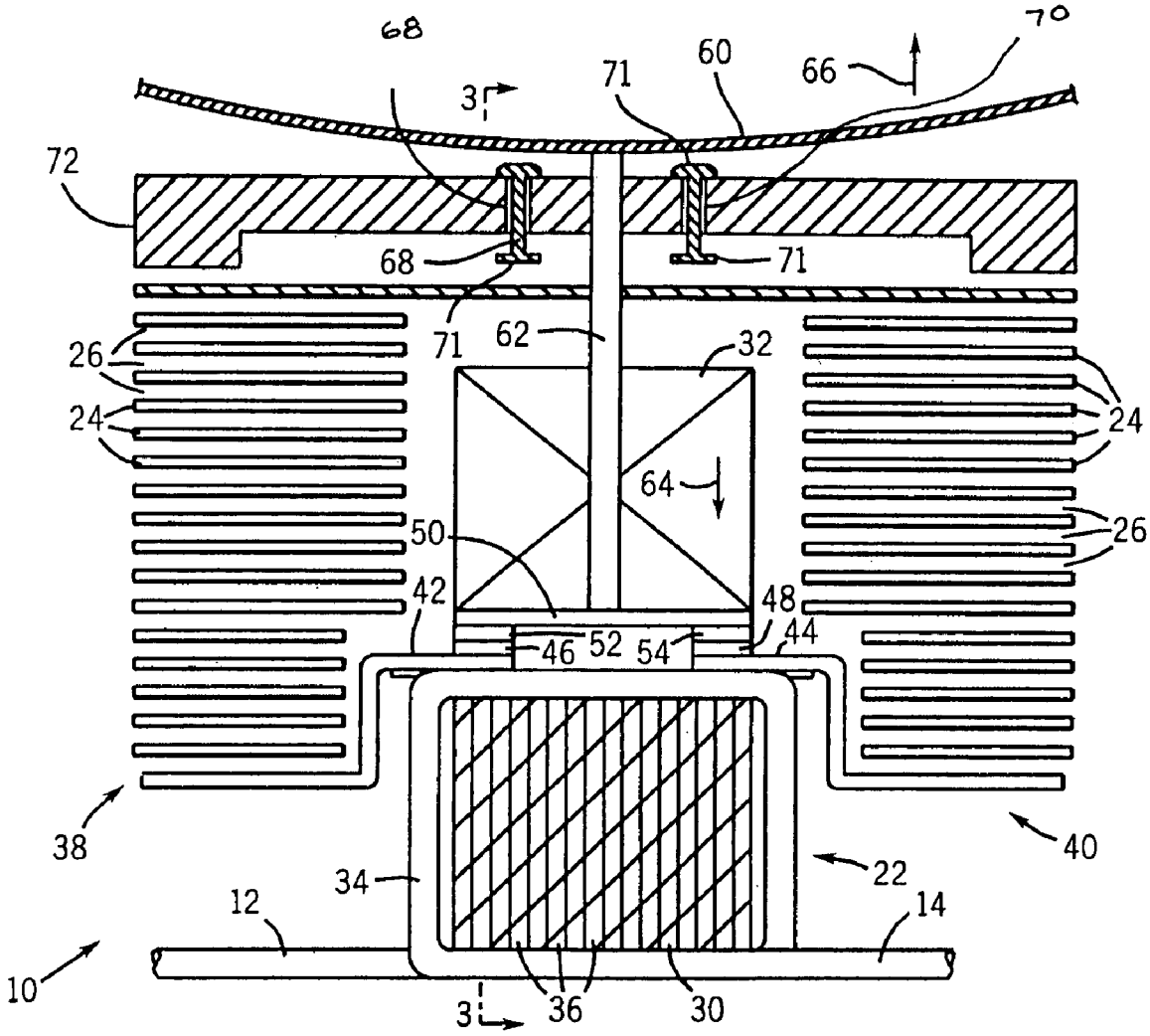
FIG. 2 is a cross-sectional view of the exemplary circuit interrupter of FIG. 1 along line 2—2, wherein the circuit interrupter is in the current carrying configuration.

As discussed in detail below, the present technique provides methods and apparatus for interrupting current carrying paths. Although the following discussion focuses on slot-motor devices, the present technique provides benefits to a number of circuit interruption devices and methods. Indeed, the following discussion merely provides exemplary embodiments, and these examples are not intended to limit the scope of the appended claims. Furthermore, as will be appreciated by those of ordinary skill in the art in view of the present discussion, the exemplary circuit interrupter is subject to various adaptations for incorporation into applications with a wide variety of devices. For example, modifications on the exemplary interrupter for incorporation into and application with single- and multi-phase devices, motor protectors, contactors and so on are envisaged.

Additionally, as a preliminary matter, the definition of the term "or" for the purposes of the following discussion and the appended claims is intended to be an inclusive "or." That is, the term "or" is not intended to differentiate between two mutually exclusive alternatives. Rather, the term "or" when employed as a conjunction between two elements is defined as including one element by itself, the other element itself, and combinations and permutations of the elements. For example, a discussion or recitation employing the terminology "'A' or 'B'" includes: "A" by itself, "B" by itself, and any combination thereof, such as "AB" and/or "BA."

Turing to the figures, FIG. 1 illustrates an exemplary circuit interrupter 10. The exemplary interrupter 10, when installed, couples an incoming or source conductor 12 to an outgoing or load conductor 14. The circuit interrupter 10 includes an outer housing 16 as well as an inner housing 18 in which the functional components of the interrupter are disposed, as discussed further below. The exemplary housing 16 is formed of an electrically insulative material to protect the components of the interrupter and to protect the environment from electrical occurrences within the interrupter 10. However, other suitable materials are envisaged. To facilitate access to the components of the interrupter 10 for maintenance, for instance, the exemplary interrupter includes a removable cap 20.

The exemplary circuit interrupter 10 also includes an interrupt initiator assembly 22 that is configured to interrupt the current carrying path through the device, as discussed further below. Disposed on either side of the exemplary interrupt initiator assembly 22 are splitter plates 24, which are separated from one another by air gaps 26. The splitter plates 24 are a source of back-EMF (electromotive force) that opposes the voltage of the external power source driving the fault current and thereby reduces fault current back down to zero at which point the arcs produced in the circuit interrupter 10 are extinguished.

Figure 3:
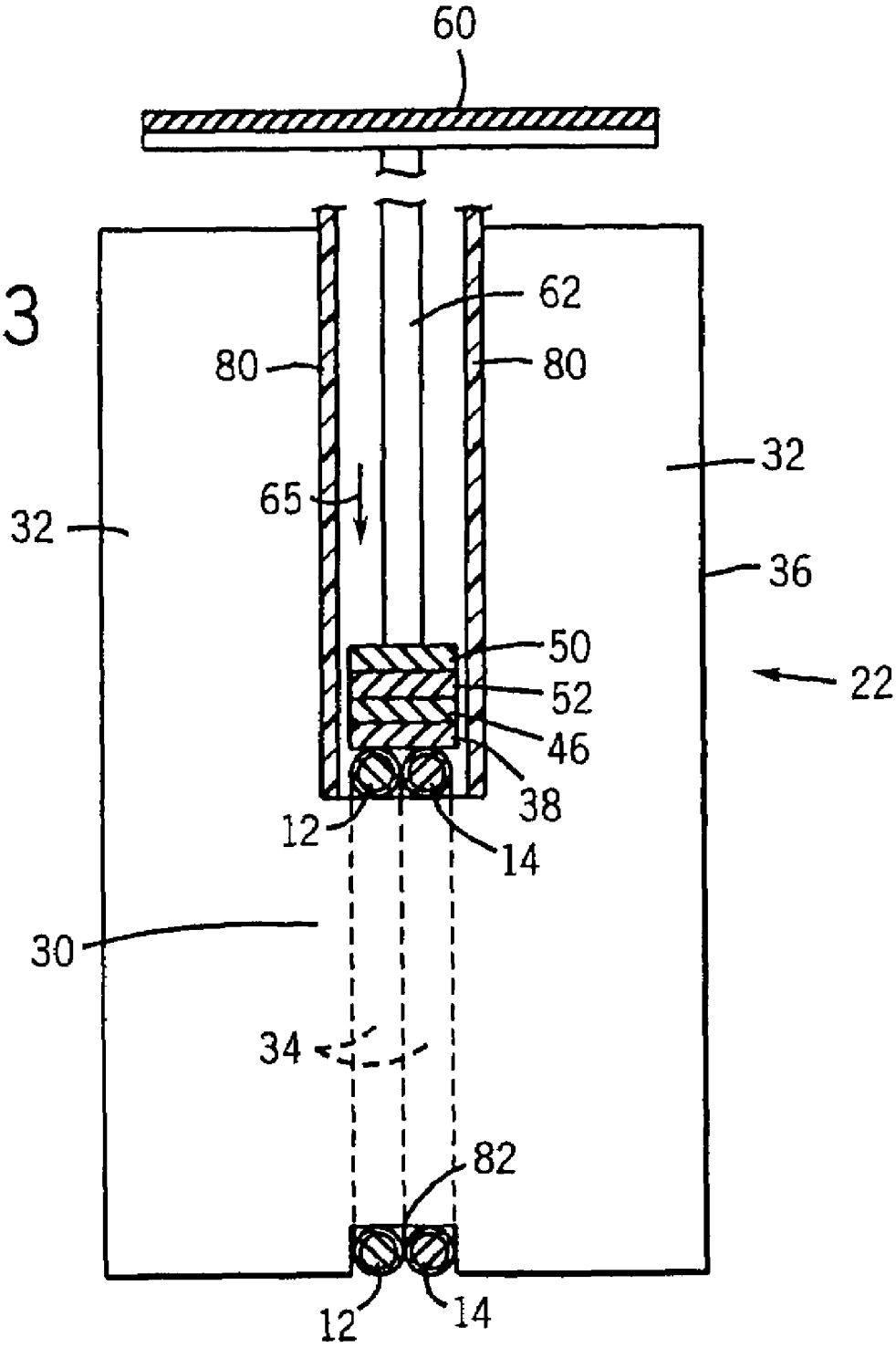
FIG. 3 is a transverse sectional view of the exemplary circuit interrupter of FIG. 2 along line 3—3.

As illustrated in FIG. 2, the exemplary circuit interrupter includes a unitary core having a lower core portion 30 and an upper core portion 32. The exemplary lower and upper core portions are formed of a series of magnetically conductive plates stacked and bound to one another to form a unitary structure. By way of example, the lower and upper core portions are formed of a ferromagnetic material, such as an electrical steel; of course, other suitable materials are envisaged. The lower core portion 30 generally extends through the device, while upper core portion 32 includes a pair of upwardly-projecting elements or panels that extend from the lower core portion 30. (These upwardly-projecting elements or panels are best illustrated in FIG. 3.)

In the exemplary circuit interrupter 10, the incoming conductor 12 is wrapped around the lower core portion 30 to form at least one turn 34 around the lower core portion 30. The turn or wrap around the lower core enhances the electromagnetic field generated by current in the incoming conductor and helps facilitate interruption of the current carrying pathway, as discussed further below. Although the conductors 12 and/or 14 may be wound around the core, the conductors 12, 14, with respect to the core, are electrically isolated from one another.

Each conductor 12, 14 includes stationary conductors 38 and 40, respectively (i.e., conductor 12 is coupled to stationary conductor 38 and conductor 14 is coupled to stationary conductor 40.) Each stationary conductor 12, 14 includes an upper surface that forms an arc runner, as represented by reference numerals 42 and 44, respectively.

The arc runners 42, 46 each includes a stationary contact 46 and 48, respectively, that are bonded and electrically coupled to the corresponding arc runner. Accordingly, the incoming conductor 12, the stationary conductor 38, the arc runner 42 and the stationary contact 46 are at the same electrical potential, and the outgoing conductor 14, the stationary conductor 40, the arc runner 44 and the stationary contact 48 are at the same electrical potential.

A moveable conductive element, such as the exemplary conductive spanner 50, electrically couples the incoming and outgoing conductors 12, 14 to one another. Specifically the conductive spanner 50 includes a pair of spanner contacts 52 and 54 that engages with the stationary contacts 46 and 48, respectively, when the interrupter is in the closed or current carrying position. To facilitate rapid displacement, the conductive spanner is formed of a lightweight and electrically conductive material. The conductive spanner 50, in cooperation with the contacts 46, 52, 48 and 54, provides an electrical pathway for current to pass from the incoming conductor 12 to the outgoing conductor 14 when the circuit interrupter is in the current carrying configuration. Advantageously, the arc runners 42, 44, the stationary conductors 38, 40, the stationary contacts 46, 48, the conductive spanner 50 and the spanner contacts 52, 54 are formed of an electrically conductive material, such as brass or silver-nickel alloys, to facilitate the flow of current through interrupter when in this current carrying configuration.

To maintain a good electrical connection between the these contacts 46, 52, 28 and 54 when the circuit interrupter 10 is in the current carrying configuration, as illustrated in FIG. 2, the exemplary interrupter 10 includes a biasing mechanism 60, such as the illustrated bi-stable leaf spring. The exemplary biasing mechanism 60 drives a stem member 62 into the conductive spanner 50 and applies a downwardly directed force (arrow 64) that pushes the spanner contacts 52, 54 into engagement with the stationary contacts 44, 46. To accommodate for mechanical tolerances, the stem 62 may include a coil spring (not shown). In the illustrated embodiment, the exemplary bi-stable element is formed of a resilient material and is flexed into an arcuate position. The exemplary bi-stable element presents an opposing force to displacement relationship with a negative slope, as discussed further below in relation to FIG. 7. That is to say, the downwardly directed force (arrow 64) applied by the bi-stable element decreases as the bi-stable element is flexed (i.e., displaced) upwardly (arrow 66). It is worth note that the illustrated bi-stable element is merely but one example of a biasing member that presents a negative slope opposing force to displacement relationship. Indeed, the biasing member may be a system of coil springs and/or resilient members that cooperate with one another to provide a cumulative effect that presents an opposing force to displacement relationship with a negative slope.

To facilitate upward displacement (arrow 66) of the bi-stable element during transition of the circuit interrupter 10 from a current carrying configuration to an interrupted configuration, the exemplary interrupter 10 includes piston elements 68 that actuate upwardly (arrow 66) and drive the biasing member 60 in the same direction. The exemplary piston elements 68 reside in passageways 70 of a structural member 72 that is mechanically coupled to the interrupter's housing 16, 18, for example. Each piston element 68 is barbell shaped and includes a connecting portion interposed between two flange portions 71. As illustrated, the connecting portions have a length that is greater than the thickness of the passageways 70, and this length defines the distance the piston elements 68 are displaceable in response to an actuating force, as discussed further below. Advantageously, the piston elements 68 are formed of a light-weight and electrically insulative material, however, any number of suitable materials are envisaged.

Certain of the foregoing elements are illustrated in the transverse sectional view of FIG. 3. As illustrated, the plates 36 of the upper and lower core portions 30 and 32 form a generally H-shaped structure. An insulating liner 80 in the exemplary circuit interrupter 10 extends between the upper core portion 32 and turns 34 and the stationary and movable contacts, to protect the core and turns from arcing. By way of example, the liner 80 includes an extension of an internal peripheral wall of inner housing 18 (see FIG. 1). Also, as discussed above, the biasing member 60 drives the stem member 62 into the conductive spanner and provides a driving force (arrow 65) that secures the stationary contacts 46, 48 into engagement with the spanner contacts 52, 54. Furthermore, FIG. 3 illustrates a trough 82 in which the outgoing conductor 14 and at least one extension of turn 34 extend therethrough.

Figure 4:
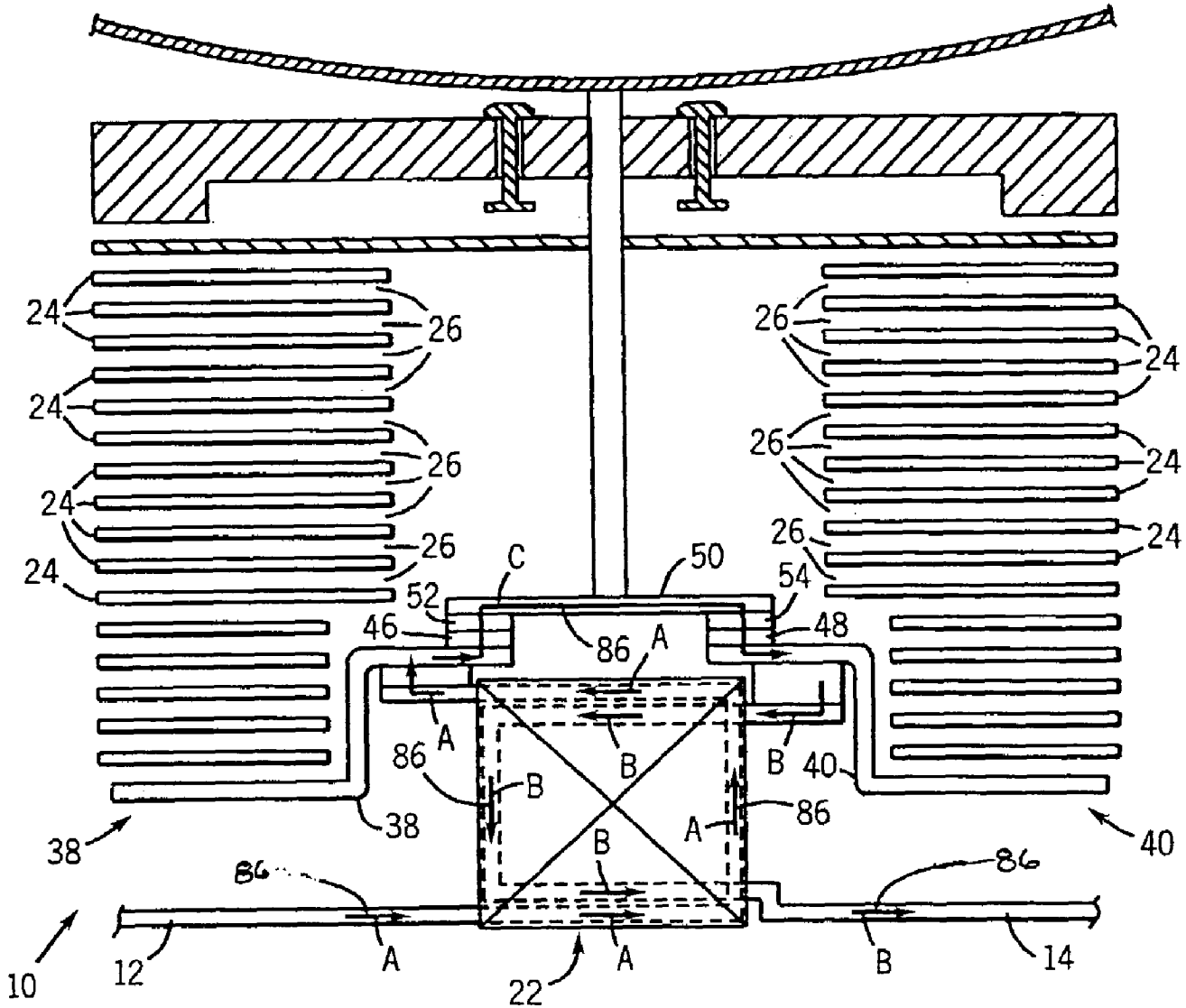
FIG. 4 is diagrammatical representation the exemplary circuit interrupter of FIG. 1, illustrating a normal or first current carrying path through the circuit interrupter.

FIG. 4 diagrammatically illustrates a current carrying path through the exemplary circuit interrupter 10 when in the current carrying configuration. During normal operating conditions (i.e., non-fault conditions), current enters the interrupter 10 via the incoming conductor 12, travels across the conductive spanner 50 and exits through the outgoing conductor 14. This path is represented generally by reference numeral 86 and includes three segments, which are labeled as "A," "B" and "C." Segment A includes conductor 12 and extends up to and partially through stationary conductor 38. As illustrated, current from the incoming conductor 12 is routed around the winding and, subsequently, into the stationary conductor 38. Similarly, segment B includes conductor 14 and a portion of the stationary conductor 40. In segment B, current is routed from the stationary conductor 40 into the outgoing conductor 14, which is wound around the lower core 30. (It should be noted that the turn or loop 34 around the lower core 30 portion and the outgoing conductor are illustrated as being stacked upon one another for the sake of illustration.) Bridging the two segments, segment C represents a current carrying path through the stationary contacts 46, 48, the spanner contacts 52, 54 and the conductive spanner 50. Thus, during normal operating conditions, current flows freely through the interrupter 10 from the incoming conductor 12 to the outgoing conductor 14, and this pathway is maintained by biasing the spanner contacts 52, 54 into engagement with the stationary contacts 46, 48. Additionally, as illustrated, segments A and B route current in an opposite direction as compared to segment C, thereby facilitating electromagnetic repulsion of the spanner 50.

Figure 5:
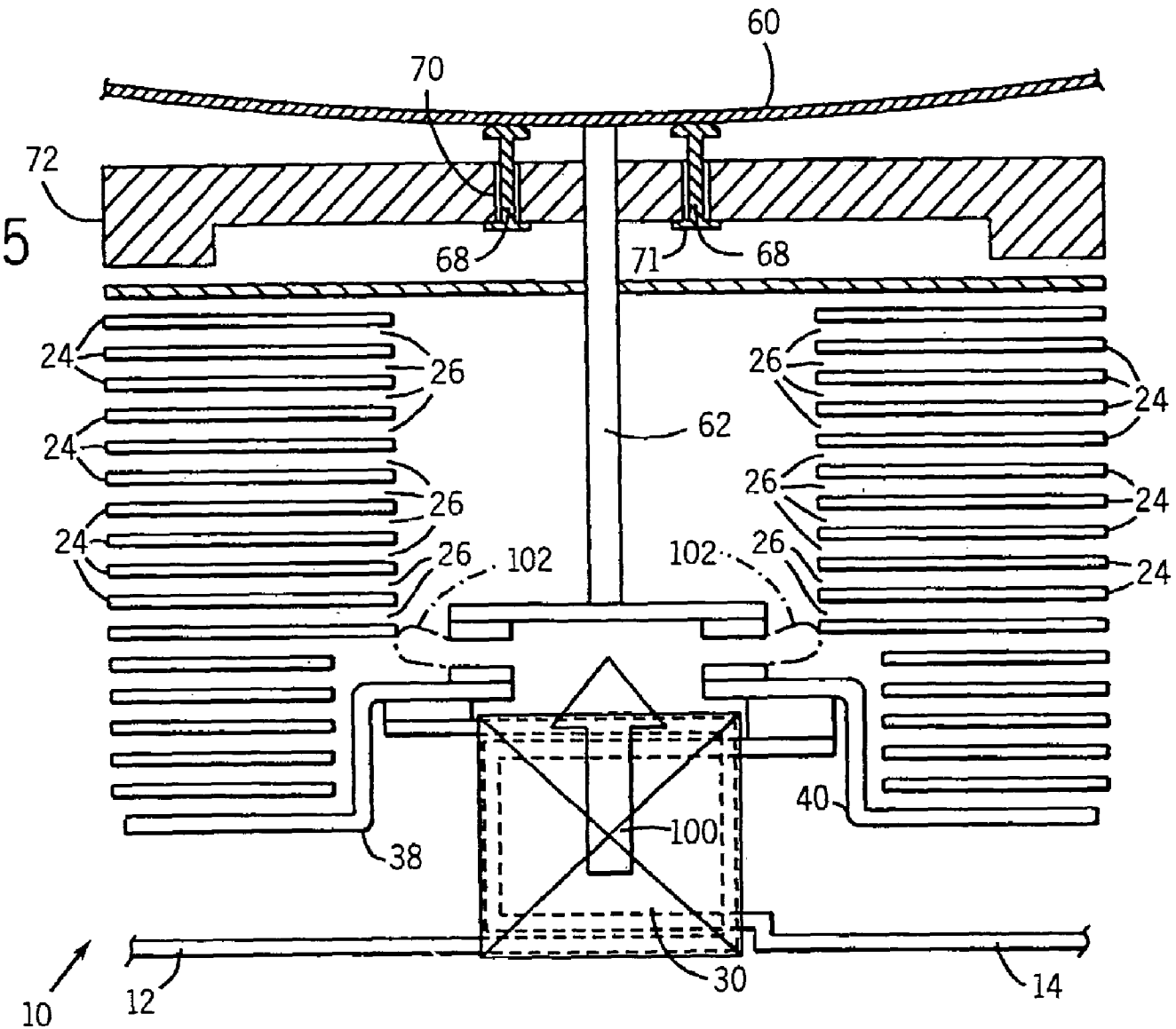
FIG. 5 is a diagrammatical representation of the exemplary circuit interrupter of FIG. 1 during an intermediate phase of transition from the current carrying configuration to the interrupted configuration.

However, in the event of a fault condition, such as an over current condition, the conductive spanner 50 and, as such, the spanner contacts 52, 54 are driven away from (arrow 100) and out of engagement with the stationary contacts 46, 48, as illustrated in FIG. 5. The conductive spanner 50 is driven in the direction of arrow 100 by the electromagnetic forces in the interrupter 10 assembly. For instance, when the current passing through the normal current carrying path 86 (see FIG. 4) reaches a threshold level (i.e., over current condition), the current is sufficient enough to develop an electromagnetic force that overcomes the downwardly directed force or opposing force (arrow 64) that is provided by the biasing mechanism 60 and that is translated to conductive spanner 50 via the stem member 62 (see FIG. 4). Accordingly, as the conductive spanner 50 is driven upwardly (arrow 100), the stem member 62 drives the exemplary bi-stable element (e.g. biasing member 60) upwardly as well. Again, the exemplary biasing mechanism has an opposing force to displacement relationship with a negative slope and, as such, provides less downward force as it is displaced upwards. Indeed, as discussed further below, the exemplary bi-stable element begins to provide an upward force beyond a certain displacement.

As the spanner contacts 52, 54 and the stationary contacts 46, 48 are separated from one another, the electrical potential of the current traveling through the incoming conductor 12 is sufficient enough to overcome the dielectric nature and resistance of the air gap between the contacts, thereby causing arcs 102 to form. Indeed, as will be appreciated by those of ordinary skill in the art in view of the present discussion, produced arcs 102 will be drawn into the splitter plates and extinguished, thereby mitigating the likelihood of undesirable power reaching the protected downstream load, for instance. The arcs 102, however, are an intense and short-lived source of heat to the internal environment of the interrupter 10.

As one consequence, heat produced by the arcs 102 causes the ambient air within the interrupter housing 18 to increase in pressure and temperature. Because the housing 18 is a relatively confined area, the pressurized air escapes through the passageways 70 and generates an airflow that lifts the piston elements 68 in the upward direction (arrow 100). Advantageously, the flanged portions 71 increase the surface area upon which the airflow acts, increasing the amount of upward force applied to the piston elements 68.

Figure 6:
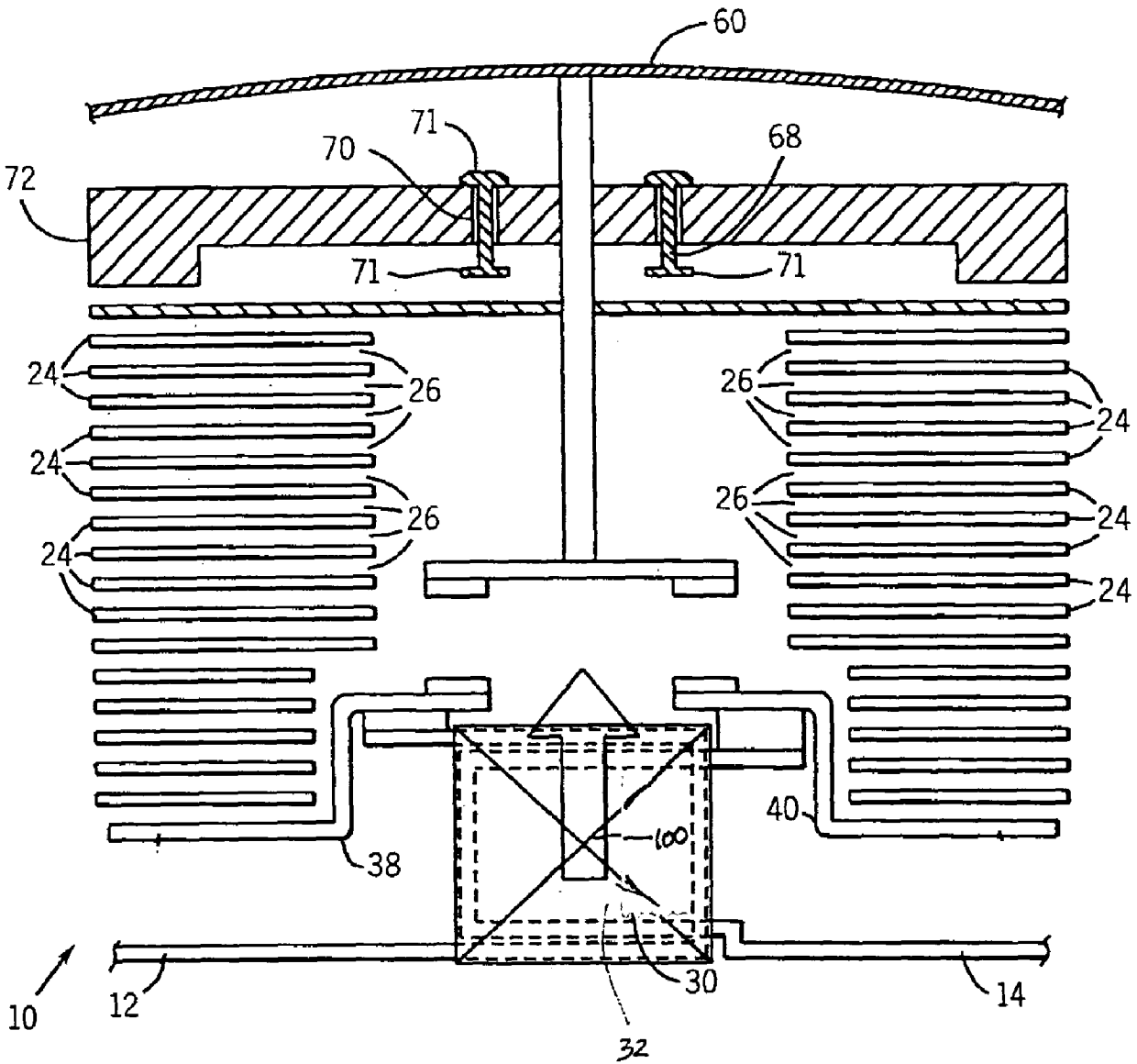
FIG. 6 is a diagrammatical representation of the exemplary circuit interrupter of FIG. 1 in the interrupted configuration.

As the piston elements 68 are driven upwardly (arrow 100), they come into contact with the exemplary bi-stable element. Accordingly, the piston elements 68 provide an upwardly directed force that acts on the biasing mechanism and that cooperates with the electromagnetic force driving the conductive spanner into the interrupted configuration. Advantageously, the force and actuation provided by the piston elements facilitate displacement of the bi-stable past the neutral point (see FIG. 7) to latch and maintain the interrupter 10 in the interrupted configuration, which is illustrated in FIG. 6.

The exemplary interrupter presents a positive feedback loop that ensures a complete current interruption (see FIG. 6) by displacing the spanner to full extension. For example, an initial fault current causes the spanner 50 to displace with respect to the stationary contact and causes the formation of arcs in the interrupter 10, as discussed above. Indeed, normal constriction forces at the contacts are sufficient to guarantee an initial displacement and initial arcing. Again, these arcs generate heat and increase the temperature and pressure of the ambient air with the interrupter 10, and the pressurized air actuates the piston elements 68. The combination of a negative slope spring versus increasing heat, pressure and drive force from the pistons resulting from elongation of the arc as a result of spanner displacement causes the force imbalance to grow and further the displacement rather than stabilize it. Accordingly, even if the fault current does not produce an electromagnetic force that is sufficient enough to drive the bi-stable element past the critical (neutral) point, the engagement and force provided by the pistons ensure sufficient displacement (full extension) and complete interruption. This relationship of a displacement leading to still greater displacements is what constitutes the positive feedback loop that insures completion of the interruption once it starts.

Thus, in the exemplary system, the pistons 68 act as a completion device that facilitates transition of the bi-stable element and the interrupter into the interrupted configuration. Indeed, the exemplary interrupter facilitates relatively large separation distances between the spanner contacts 52, 54 and the stationary contacts 46, 48. Thus, the exemplary circuit interrupter affords benefits to relatively high voltage applications (e.g., 600V and above), which benefit from larger spanner displacements to interrupt successfully.

In the interrupted configuration, the conductive spanner 50 has traveled far enough away from the stationary contacts 46 and 48 to prevent the production of arcs 102, and all previously produced arcs 102 have been extinguished via the splitter plates 24, among other components of the interrupter 10. Once in the interrupted configuration, no current passes from the incoming conductor 12 to the outgoing conductor 14, thereby protecting the downstream load from any undesirable power or power event. Once the fault-triggering event has passed or been resolved, the interrupter 10 may be reset by driving the biasing member downwardly, either manually or mechanically, for instance, to place the biasing member back into the normal current carrying configuration as illustrated in FIG. 4. Indeed, as discussed further below, the bi-stable nature of the biasing member causes the biasing member to remain in the up or interrupted configuration until acted upon by another force.

Turning to FIG. 7, and with FIGS. 1–6 in mind, a graphical illustration of the opposing force provided by the exemplary bi-stable element in relation to spanner displacement and in comparison to a traditional coil spring is provided. The origin of the graph, reference numeral 120, represents a zero distance between the spanner contacts 52,54 and the stationary contacts 46, 48 (along the X-axis 122) and a zero magnitude of the downwardly directed opposing force provided by the biasing member 60 (increasing along the Y-axis 124). In the present illustration, curve 126 represents the opposing force vs. displacement relationship of a traditional coil spring, while curve 128 represent a force vs. displacement relationship of the exemplary bi-stable element.

When in the normal current carrying configuration, as illustrated in FIG. 2, the spanner contacts 52, 54 are in direct engagement with the stationary contacts 46, 48, and the displacement of the spanner is zero. As discussed above, when the in the current carrying configuration, the biasing member, whether the exemplary bi-stable element or a traditional coil spring, applies a downwardly directed opposing force on the conductive spanner 50, to ensure a good electrical connection between the stationary and spanner contacts. The magnitude of the opposing force at this point in time is represented by reference numeral 130. As illustrated, the exemplary bi-stable element and the traditional coil spring member provide an equal magnitude of opposing force to the conductive spanner when in the starting position.

However, when an over current condition is detected, then the electromagnetic relationships and forces discussed above cause the spanner 50 to move upwardly, increasing the distance between spanner contacts 52, 54 and the stationary contacts 46, 48. In a traditional coil spring assembly, this increase in displacement causes the coil spring to compress and, in turn, increases the downwardly directed opposing force provided by the spring, as illustrated by curve 126. Thus, in traditional coil spring based devices, the increasing opposing force requires an increase in the electromagnetic forces to drive the conductive spanner 50 to a point where the arcs 102 are extinguished, i.e., the interrupted configuration as illustrated in FIG. 6. Because of this increasing opposing force, traditional coil spring devices require a relatively substantial fault current to overcome the biasing force to fully interrupt the current carrying path.

Accordingly, coil spring based interrupters are generally not readily integrated with magnetic interrupters, such as slot motor interrupters. Moreover, this increasing opposing force to displacement relationship also presents difficulty in application to relatively high voltage application (e.g., 480V), because of the relatively large separation distance required to ensure complete extinguishing of the arc and interruption of the current carrying path.

By contrast, the exemplary bi-stable element has an inverse relationship between opposing force and spanner displacement, as illustrated by curve 128. That is to say, the exemplary bi-stable element has a negative slope opposing force to displacement relationship. In this assembly, the exemplary bi-stable element applies lesser opposing force to the conductive spanner 50 as the spanner is further displaced by the electromagnetic forces within the interrupter 10. Advantageously, the piston elements 68, which are actuated by the pressurized air that is in the assembly and that is a result of arcing, assists in displacing the bi-stable element and ensures that the bi-stable element reaches and passes the neutral point, which is represented by numeral 132.

At the critical (neutral) point 132, the displacement of the conductive spanner and, as such, the bi-stable element is such that the bi-stable element no longer provides an opposing force to the conductive spanner 50. That is, the bi-stable element provides neither a positive nor negative biasing or opposing force to the conductive spanner. However, the bi-stable element is not internally stable at this position and will snap into the current carrying (i.e., concave) configuration or the interrupted (i.e., convex) configuration. Accordingly, as discussed above, actuation of the piston elements 68 against the bi-stable element facilitates transition of the bi-stable into the negative opposing force region which is represented by the region of the curve below the X-axis 124.

In this region of the exemplary curve 128, the bi-stable element biases the conductive spanner 50 upwardly and, as such, in the same direction as the electromagnetic forces. Indeed, once the critical (neutral) point 132 is crossed, the bi-stable element will bias upwardly and travel to completion (i.e., the interrupted configuration). The displacement of the bi-stable member to the point of completion or the interrupted configuration is represented by numeral 136. Advantageously, the bi-stable element remains in this interrupted configuration until reset, thereby lessening the need for mechanical latching mechanisms to secure the conductive spanner 50 in the interrupted configuration.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A circuit interrupter, comprising:

first and second electrical conductors;

a third electrical conductor configured to electrically couple the first and second conductors when the interrupter is in a first configuration;

a displacement mechanism configured to displace the third electrical conductor away from the first and second conductors to electrically uncouple the first and second conductors and to transition the interrupter into a second configuration;

a biasing mechanism configured to provide a biasing force to bias the third conductor toward the first and second conductors, wherein the biasing force decreases as the interrupter transitions from the first configuration to the second configuration, wherein the biasing mechanism comprises a leaf-spring; and a completion device configured to facilitate transition of the biasing mechanism to the second configuration in response to arcs between the first and third conductors or between the second and the third conductors.

2. The circuit interrupter as recited in claim 1, wherein the biasing mechanism comprises a bi-stable element.

3. The circuit interrupter as recited in claim 1, wherein the biasing mechanism is configured to provide a further biasing force in the direction of the displacement after the biasing force decreases to a magnitude of zero.

4. The circuit interrupter as recited in claim 1, wherein the displacement mechanism is configured to produce an electromagnetic force to displace the third conductor.

5. The circuit interrupter as recited in claim 1, wherein the completion device comprises a piston element.

6. The circuit interrupter as recited in claim 5, comprising a housing, wherein the piston element actuates in response to increased pressure within the housing.

7. The circuit interrupter as recited in claim 1, comprising a plurality of splitter plates.

8. A circuit interrupter, comprising:

a housing;

first and second electrical conductors disposed in the housing;

a third electrical conductor disposed in the housing and configured to transition between engaged and disengaged positions with respect to the first and second electrical conductors;

an electromagnetic field source configured to provide an electromagnetic force to displace the third electrical conductor into the disengaged position;

a biasing mechanism configured to provide a biasing force to the third conductor that opposes the electromagnetic force, wherein the biasing force decreases as the third conductor transitions from the engaged position to the disengaged position, wherein the biasing mechanism comprises a leaf-spring; and a piston element configured to facilitate transition of the third conductor from the engaged position to the disengaged position, wherein the piston element actuates in response to an increase of pressure in the housing.

9. The circuit interrupter as recited in claim 8, wherein the biasing mechanism comprises a bi-stable element.

10. The circuit interrupter as recited in claim 8, wherein the biasing mechanism is configured to provide a further force that maintains the third conductor in the disengaged position after the biasing force is decreased to a magnitude of zero.

11. The circuit interrupter as recited in claim 8, comprising a plurality of splitter plates disposed in the housing.

12. The circuit interrupter as recited in claim 8, wherein the third conductor cooperates with the first and second conductors to produce arcs during transition of the third conductor from the engaged position to the disengaged position.

13. The circuit interrupter as recited in claim 8, wherein the third conductor is displaced in response to a 15 times rated current in the electromagnetic field source.

14. The circuit interrupter as recited in claim 8, wherein the first and second conductors are configured to route a 100 A (amp) current.

15. The circuit interrupter as recited in claim 8, wherein the first and second conductors each includes a stationary contact configured to engage with spanner contacts located on the third conductor to electrically couple the first, second and third conductors to one another.

16. The circuit interrupter as recited in claim 8, wherein the biasing mechanism provides a further force that is in the direction of the electromagnetic force and that is present after the biasing force reaches a magnitude of zero.

17. The circuit interrupter as recited in claim 16, wherein the further force increases as the third conductor is displaced away from the first and second conductors.

18. A circuit interrupter comprising:

a first electrical conductor configured to receive electrical power from a power source;

a second electrical conductor configured to route power to a downstream load;

a third conductor positionable between a normal operating position to electrically couple the first and second electrical conductors and a disengaged position with respect to the first and second electrical conductors;

an electromagnetic field source configured to provide an electromagnetic force to displace the third conductor away from the first and second conductors and into the disengaged position;

a bi-stable element configured to provide a biasing force to drive the third electrical conductor into engagement with the first and second conductors, wherein the biasing force decreases as the third conductors transitions from the engaged position to the disengaged position, wherein the bi-stable element comprises a leaf-spring; and a piston element configured to actuate in response to the development of arcs between the first, second and third conductors during transition of the third conductor from the engaged position to the disengaged position, wherein the piston element provides a further force in the direction of the displacement of the third conductor.

19. The circuit interrupter as recited in claim 18, wherein the first and second conductors are configured to route a high-voltage current.

20. The circuit interrupter as recited in claim 18, comprising a plurality of splitter plates disposed outboard of the first or second conductor.

21. The circuit interrupter as recited in claim 18, wherein the bi-stable element is configured to maintain the third conductor in the disengaged position after the biasing force reaches a magnitude of zero.

22. The circuit interrupter as recited in claim 18, wherein the first conductor is configured to receive a high-voltage current, and wherein the disengaged position displaces the third conductor to prevent arcing between the first conductor and the third conductor.

23. The circuit interrupter as recited in claim 22, wherein the high-voltage current is greater that 480 Volts (V).

24. A method of interrupting a current carrying path, comprising:

electrically coupling first and second conductors via a third conductor extending therebetween;

displacing the third conductor away from the first and second conductors via an electromagnetic force to interrupt a current carrying path from the first conductor to the second conductor and to generate arcs between the third conductor and the first or second conductor;

providing a biasing force to bias the third conductor toward the first and second conductors, wherein the biasing force is provided by a leaf-spring and decreases as the third conductor is displaced with respect to the first and second conductors; and actuating a completion device in response to arcs between the third conductor and the first or second conductor to facilitate displacement of the third conductor.

25. The method as recited in claim 24, comprising actuating a piston element to provide a further force in the direction of the displacement of the third conductor to facilitate interruption of the current carrying path.

26. The method as recited in claim 24, comprising generating an electrical arc between the first or second conductor and the third conductor.

27. The method as recited in claim 24, comprising providing a further force in the direction of the displacement of the third conductor after the biasing force reaches a magnitude of zero.

28. A method of interrupting a current carrying path, comprising:

separating first and second electrical contacts with respect to one another to generate an electrical arc therebetween;

actuating a piston element in response to generation of the electrical arc to facilitate separation of the first and second contacts with respect to one another; and decreasing a biasing force provided by a leaf-spring and applied to the first or second contact biasing the first contact or second contact toward one another in response to an increase of a separation distance between the first and second electrical contacts.

29. The method as recited in claim 28, comprising providing a further force in the direction of the separation of the first and second electrical contacts after the biasing force reaches a magnitude of zero.

30. The method as recited in claim 28, comprising maintaining the separation distance via the further force to maintain interruption of the current carrying path.

31. The method as recited in claim 28, comprising dissipating an electrical current from the first conductor in a plurality of splitter plates.

32. A method of interrupting a current carrying path, comprising:

providing an electrically conductive spanner that electrically couples first and second electrical conductors;

providing a displacement mechanism configured to displace the electrically conductive spanner away from the first and second conductors to electrically uncouple the first and second conductors from one another; and providing a biasing mechanism configured to provide a biasing force to bias the third conductor toward the first and second conductors, wherein the biasing mechanism comprises a leaf-spring and the biasing force decreases as the conductive spanner displaces away from the first and second conductors.

33. A circuit interrupter, comprising:

means for separating first and second electrical contacts with respect to one another to generate an electrical arc therebetween; and means for decreasing a biasing force applied by a leaf-spring to the first or second contact that is biasing the first contact or second contact toward one another in response to an increase of a separation distance between the first and second electrical contacts.

* * * * *